US005465539A

United States Patent [19]

Rose

[11] Patent Number: 5,465,539

[45] Date of Patent: Nov. 14, 1995

[54] WINDOW ASSEMBLY WITH PLANT-ON

[76] Inventor: Gary T. Rose, 38079 Klarr Dr., Northville, Mich. 48167

[21] Appl. No.: 971,726

[22] Filed: Nov. 4, 1992

[51] Int. Cl.[6] ..... F06B 1/04

[52] U.S. Cl. ..... 52/204.53

[58] Field of Search ..... 52/204.53, 204.54, 52/211, 212, 455, 456; 49/381

[56] References Cited

U.S. PATENT DOCUMENTS

| | | | |
|---|---|---|---|
| 346,187 | 7/1886 | Boda | 52/211 X |
| 395,945 | 1/1889 | Boda | 52/211 |
| 450,081 | 4/1891 | Mesker | 52/211 X |
| 634,739 | 10/1899 | Stearns | 52/211 |
| 985,886 | 3/1911 | Dahlstrom | 52/211 |
| 2,080,555 | 5/1937 | Beil et al. | 52/211 |
| 2,293,648 | 8/1942 | Horn | 52/212 X |
| 2,614,665 | 10/1952 | Floyd | 52/212 |
| 2,944,305 | 7/1960 | Avery | 52/212 |
| 3,042,160 | 7/1962 | Price | 52/212 |
| 3,323,262 | 6/1967 | Cesare et al. | 52/212 |
| 3,641,721 | 2/1972 | Marten | 52/212 |
| 4,012,868 | 3/1977 | Andruszkiewicz | 52/212 X |
| 4,407,100 | 10/1983 | Huelseskopf | 52/212 |
| 4,601,138 | 7/1986 | Hampton | 52/211 X |
| 4,601,144 | 7/1986 | Tinti | 52/211 |
| 4,780,998 | 11/1988 | Knapp | 52/204.53 |
| 4,783,938 | 11/1988 | Palmer | 52/171 |
| 4,811,533 | 3/1989 | Wetsel | 52/211 |
| 4,837,977 | 6/1989 | Mauro . | |
| 4,989,384 | 2/1991 | Kinghorn et al. | 52/456 |
| 5,046,546 | 9/1991 | Benedyk et al. | 160/371 |
| 5,081,793 | 1/1992 | Mauro . | |
| 5,134,814 | 8/1992 | Hauser | 52/212 X |

FOREIGN PATENT DOCUMENTS

| | | | |
|---|---|---|---|
| 1038128 | 9/1978 | Canada | 52/211 |
| 2624165 | 12/1977 | Germany | 52/212 |
| 1247787 | 9/1971 | United Kingdom | 52/211 |

*Primary Examiner*—Peter M. Cuomo
*Assistant Examiner*—Jerry Redman
*Attorney, Agent, or Firm*—Brooks & Kushman

[57] ABSTRACT

A window fabrication with plant-on is disclosed for simulating different building architectures. The apparatus includes at least one sash, a pair of glazings, a frame and at least one plant-on. The plant-on can be either a factory plant-on which is applied to the window fabrication before final installation or a field plant-on which is applied to the window fabrication substantially concurrent with final installation.

22 Claims, 5 Drawing Sheets

528
530
520
521
522
524
170
170
112
518
514
160
111
516

186
182
626
185
152
188
183
113
187
174
170
524
515
115
514
520
222
112
115

111
224
160

WINDOW ASSEMBLY WITH PLANT-ON

TECHNICAL FIELD

The present invention relates generally to window assemblies and, in particular, to stylized window assemblies which combine insulated windows with decorative plant-ons to simulate the appearance of different architectural styles.

BACKGROUND ART

Many building owners prefer traditional or historical period aesthetic appearances, and such appearances often include double-hung windows. Although double-hung windows have been designed in a wide range of ornamental architectures, they are typically less efficient than alternative window styles since they include two sashes with separate glazings that must be relatively easy to move while sealing against air leakage. Furthermore, screens for double-hung windows are installed on the exterior portion of the window so that the sash may be easily manipulated from inside the building. However, such positioning of the screen detracts from the exterior appearance of the windows and from the appearance of the entire exterior building elevation. Thus, the addition of screens may hide the architectural ornamentation contributed by the design of the windows.

A casement window addresses some of the problems associated with double-hung windows. Casement windows are more efficient than double-hung windows because they generally have a single sash. Moreover, the casement sash opens generally pivot about a vertical axis and open outwardly from the frame. Thus, any wind currents against the building wall supporting the windows tends to seal the window even tighter against the frame. Such an opening mechanism permits the installation of screens on the interior portion of the window. Unfortunately, the more modern structure of casement windows is aesthetically different from traditional double-hung window styles which would match traditional styles of architecture.

Although there are previously known decorative structures that have been manufactured for decorating building elevations, these ornamentations have not found ready acceptance in the building industry. Decorative structures, such as molded foam columns and headers, must be custom fitted at the construction site, for example, by cutting the columns and heads to a length that matches an installed window height and joining the corners. Such on-site labor substantially increases cost and difficulty of construction, and delays the completion date of newly constructed buildings. This customization is prohibitively expensive and therefore impractical for most building construction, and does not promote attempting to simulate architectural stylings on existing structures.

Furthermore, efforts to simulate actual architectural stylings such as arch topped windows are expensive and difficult to construct, particularly where double-paned insulating windows are to be installed. Contouring the glass panels, the frame, the sash and the spacers to produce a window with a contoured edge and assembling the two panes of contoured glass in sealed relation in a contoured frame would be uncommonly difficult. The curvature makes forming, fitting and sealing such components a complex task, and results in increased cost.

Accordingly, previously known window constructions do not provide the advantage of an efficient and easily installed window assembly which provides the aesthetic appearance of various architectural styles and which permits the installation of a screen without significantly affecting the appearance of the exterior elevation.

SUMMARY OF THE INVENTION

The present invention resolves the previously encountered problems by providing an insulated window assembly which includes a window in combination with a set of one or more prefabricated decorative moldings, called plant-ons, to simulate architecture stylings. The window assembly generally comprises a window having a sash frame supporting inner and outer panes secured in the sash in parallel, spaced-apart relation by a spacer to form a chamber therebetween. The window assembly further includes a window frame carrying the sash and at least one plant-on having a matching dimension corresponding to a dimension of the window. As a result, the combination of the present invention provides an insulated window enhanced through the installation of corresponding decorative plant-ons that simulates the appearance of an architectural styling without the inefficiency and structural difficulties of conventional window construction.

There are two types of plant-ons in the present invention. The first type is a factory plant-on which is applied to a surface of the window assembly such as the glass, sash frame, window frame or another plant-on. The second type is a field plant-on which is applied to the building or wall structure adjacent to a window opening with its matching dimension lying adjacent to a contiguous dimension of an adjacent window. Plant-ons have an alignment means for positioning the plant-on adjacent to the contiguous dimension of the sash or frame, which can be for example, a simple mounting fastener or a finished surface of the plant-on. The plant-ons may be made of wood or another material different from the sash and frame, such as polyurethane foam.

One embodiment of the present invention might include one or more plant-ons forming a checkrail on a casement sash and frame assembly. A casement window crank assembly provides a crank-out double-hung window, although a stationary casement window is also within the scope of the present invention.

These checkrail plant-ons are pieces of decorative molding which are attached, preferably in a removable manner, to the pane or sash frame of the window. As used herein the term removable is to be understood as referring to a secure attachment which permits field reglazing without destruction of the window components. As an example, adhesive tape which can be sliced from the glass surface without breaking the glass is a removable retainer according to the invention. Even though it is not readily separable by hand. Moreover, the ease of manual separation should be limited to avoid inadvertent displacement of the plant-ons under environmental conditions and during handling.

Preferably, the checkrail includes at least one of an interior glass plant-on, an exterior glass plant-on and an internal muntin bar. Each glass plant-on is attached in a horizontal orientation to the respective interior or exterior pane, the sash frame or both. An internal muntin bar is positioned horizontally between the panes in alignment with the checkrail plant-on. Preferably, the glass plant-ons have an upper surface that is tapered, the height of the surface of the plant-on adjacent to the pane being greater than the height of the opposite surface of the plant-on to appear deeper than its actual depth.

Preferably, the checkrail includes external, interior and internal elements installed in alignment with one another and, the exterior and interior plant-ons are in alignment with the internal muntin bar positioned between the panes.

In another preferred embodiment, one or more exterior field plant-ons are provided for installation with a casement window. One such plant-on is a crosshead. A crosshead is a piece of decorative molding which is attached in a horizontal orientation to a window frame or wall on top of the casement window. Crossheads are typically used to enhance the appearance of a window or alter the exteriorly perceived dimensions of a window.

Similarly, exterior plant-ons of the preferred embodiment include a pair of pilasters or decorative columns. A pilaster is positioned in a vertical orientation along the side of the window. Like crossheads, pilasters are typically used to enhance the appearance of a window or alter the exteriorly perceived dimensions of a window. A pilaster is attached to the wall adjacent to the window assembly and may have finished ends to form an alignment indicia for positioning the matching dimension against a contiguous dimension of the window such as the window frame edge or an adjacent plant-on such as a crosshead.

Depending on the architectural style, the pilasters of the preferred embodiment may also include one or more plinth blocks. Plinth blocks are decorative ornaments which are attached to pilasters and crossheads at predetermined positions to simulate a particular architectural style.

In another advantageous embodiment, plant-ons simulate configured panes with contoured edges. A contoured sash plant-on can be used to produce such an effect. To simulate an arched pane, for example, a sash plant-on having a curved lower edge can be attached to the sash and installed to be visible from the exterior pane. Preferably, the plant-ons include both interior and exterior panels of corresponding shapes and are aligned with an internal muntin bar of corresponding shape. Moreover, each plant-on preferably comprises a glass plant-on closely adjacent to a pane and a sash frame plant-on overlapping the glass plant-on and providing a shadowing effect enhancing the configured shape simulation of the glass.

The preferred embodiment also includes a variety of muntin bar constructions. A muntin bar is located between the panes of a thermal window to produce a divided light, or multiple pane window effect. By incorporating muntin bars, a number of divided light effects can be achieved such as a grid of smaller window surfaces or, as previously described, a double-hung window simulation. Muntin bars are most effective as style simulators when used in conjunction with similarly aligned and sized glass plant-ons.

Thus, the present invention provides a variety of architectural stylings while simplifying the structure of the window and reducing the difficulty and costs of assembling and installing the window.

BRIEF DESCRIPTION OF THE DRAWINGS

The present invention will be more clearly understood by reference to the following detailed description when read in conjunction with the accompanying drawing in which like reference characters refer to like parts throughout the view and in which.

DETAILED DESCRIPTION OF THE DRAWINGS

Figure 1:
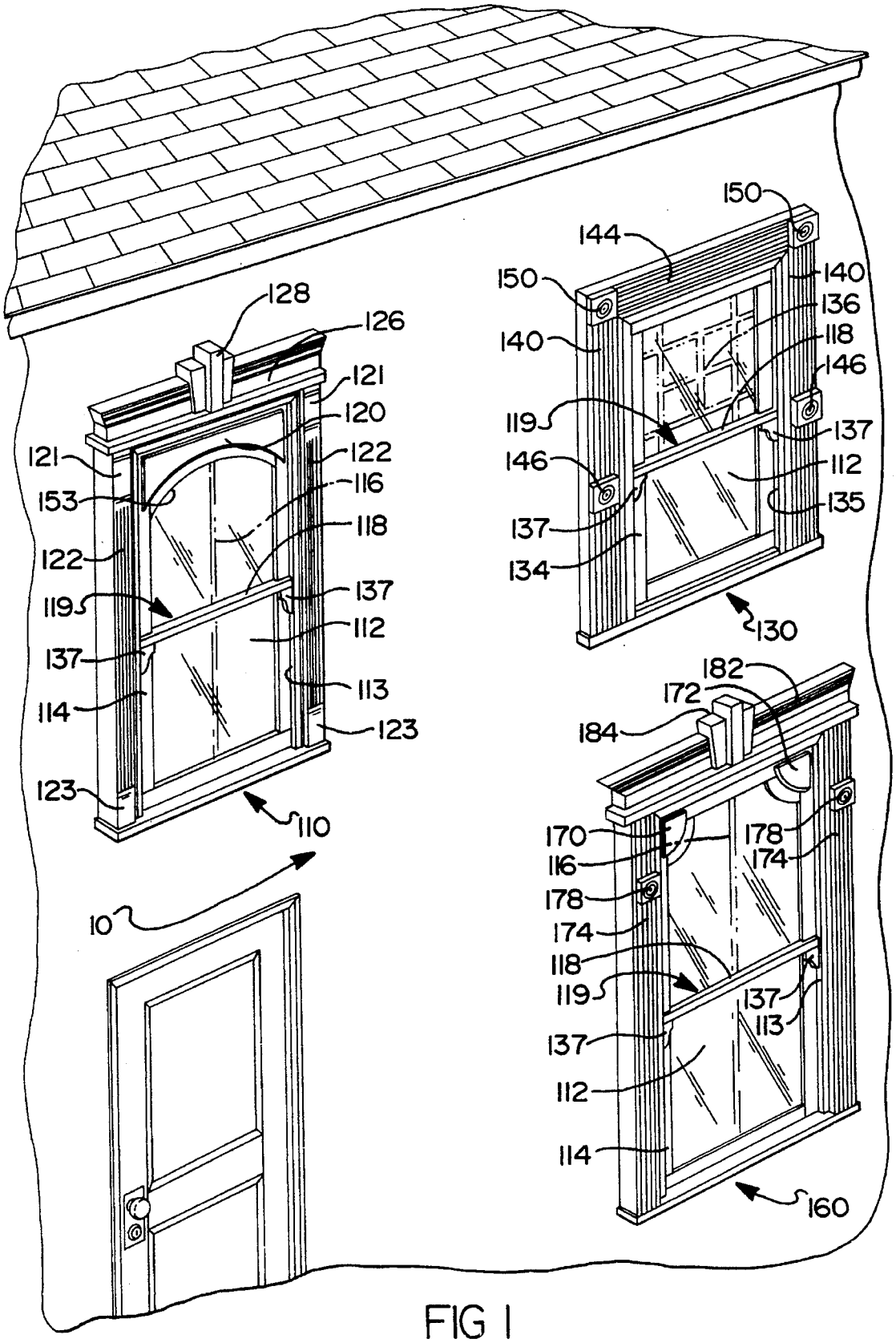
FIG. 1 is a front perspective view of a building elevation including a plurality of window assemblies constructed according to the present invention.

FIG. 1 shows a building elevation 10 including three insulated window assemblies 110, 130 and 160 made in accordance with the present invention. Although each window assembly visually represents a different architectural style, the selection of styles on each building elevation may be coordinated or varied as desired without departing from the scope of the present invention.

A first window assembly 110 comprises a sash 114 carried by a frame 113. The frame 113 is mounted in a wall opening 152 (FIG. 6) in a well known manner. A vertical internal muntin bar 116 is positioned between a pair of panes 112 defining a single lite to simulate the appearance of a divided lite window.

An exterior glass plant-on 118 comprising a portion of a checkrail assembly 119 is shown centrally positioned in a horizontal alignment over the pair of panes 112. This checkrail assembly 119 simulates the appearance of a double-hung window assembly while providing the advantages of a casement insulated window assembly, as will be described in greater detail. A pair of sash stop plant-ons 137 are mounted to the sash below the ends of the plant-on 118 to ornamentally represent a support for the perceived upper sash.

An exterior sash plant-on 120 is attached to the exterior upper portion of the sash 114 and to a layered glass plant-on 153. The curved lower edge of this plant-on 120 gives the appearance that the pair of panes 112 have a curved upper edge. This plant-on 120 is preferably used in conjunction with a curved internal muntin bar (discussed in greater detail in FIG. 6) positioned between the pair of panes 112 to approximate the same curvature as that of the lower edge of plant-on 120. This plant-on 120 is further preferably used in conjunction with an internal glass plant-on attached to the interior upper portion of the sash 114 and positioned to approximate the same curvature as that of the exterior plant-on 120. Preferably, both the internal and external plant-ons also have layered components as discussed in greater detail hereinafter.

Two columns 122 are shown attached to the wall adjacent to frame 113. The columns 122 ornament the window assembly 110 to simulate a window trim structure which is wider than the actual window frame 113 of window assembly 110 and may represent an architectural styling consistent with the architectural features of building 10. The columns have ornamentally defined top ends 121 and ornamentally defined bottom ends 123. Although moldings 122, top ends 121 and bottom ends 123 are similarly designed on both the left and right sides of window 110, corresponding left side and right side ornamentation such as mirror image designs are within the scope of the present invention.

Crosshead 126 is attached to the wall adjacent to the upper portion of frame 113. Crosshead 126 provides ornamentation to the window assembly 110 that simulates a window trim structure which is taller than the actual window frame of window assembly 110. Head key 128 may form part of or be separately attached to crosshead 126 to further simulate a specific architectural style.

A second window assembly 130 comprises a sash 134 in frame 135. A grid of internal muntin bars 136 is positioned between a pair of panes 112 forming a single lite in sash 134. The grid provides the appearance of multiple panes in the upper portion of a divided lite window.

An exterior glass plant-on 118 forms a portion of a checkrail assembly 119 shown centrally positioned over the sash 134. This checkrail assembly 119 simulates the appearance of a double-hung window assembly while providing the advantages of a casement insulated window assembly. A pair of sash stop plant-ons 137 are mounted to the sash below the ends of the plant-on 118 to ornamentally represent a support for a perceived upper sash.

Two moldings 140 are shown attached to the wall adjacent to frame 135. The moldings 140 simulate a window trim structure which is wider than the actual window frame of window assembly 130. Unlike the columns 122, the moldings do not have ornamentally defined top ends and bottom ends. However, plinth blocks 146 are attached to moldings 140 to further simulate a specific architectural style. Moreover, the plinth blocks may be positioned at the ends or along the length of the moldings 140.

Molding 144 is attached to the wall adjacent to the upper portion of sash 134. Molding 144 conforms with the ornamentation of the side moldings 140 to simulate a window trim structure which is taller than the actual window frame 135 of window assembly 130. Plinth blocks 150 are attached to molding 144 and moldings 140 to further simulate a specific architectural style.

A third window assembly 160 comprises a sash 114 and frame 113. A vertical muntin bar is positioned within a pair of panes 112 forming a single lite to provide the appearance of a divided light window.

An exterior glass plant-on 118 forms a portion of a checkrail assembly 119 and is shown centrally positioned over the sash 112. This checkrail 118 is also positioned over stop plant-ons 137 and simulates the appearance of a double-hung window assembly while providing the advantages of a casement insulated window assembly.

Sash plant-on assemblies 170 and 172 are attached to the upper portion of the sash 114. The curved lower edges of these plant-ons 170 and simulate curved upper corners for the pair of panes 112. These plant-on assemblies 170 and 172 preferably cooperate with curved internal muntin bars (not shown) positioned between the pair of panes 112 (as will be discussed in detail in reference to FIG. 6) to approximate the same curvature as shown by plant-on assemblies 170 and 172. These plant-on assemblies 170 and 172 preferably include interior plant-ons which attach to the interior upper portion of sash 114 to simulate curved upper corners of the pair of panes 112 from an interior perspective.

Two side moldings 174 are shown attached to the wall adjacent to sash 114. The side moldings 174 are similar to the ornamental side moldings 140 although the top ends are cut to mate with a crosshead 182. Plinth blocks 178 are attached to moldings 174 to further simulate a desired architectural style.

Crosshead 182 is attached to the wall adjacent to the upper portion of frame 113. Crosshead 182 simulates a window trim structure which is taller than the actual window frame of window assembly 160. Head block 184, like the block 128, is attached to or formed with crosshead 182 to further simulate a specific architectural style. The block 128 may form a centering aid that forms an alignment indicia for positioning the crosshead properly around the window. Likewise, the ends of the crosshead may be marked for proper positioning over the window frame.

Figure 2:
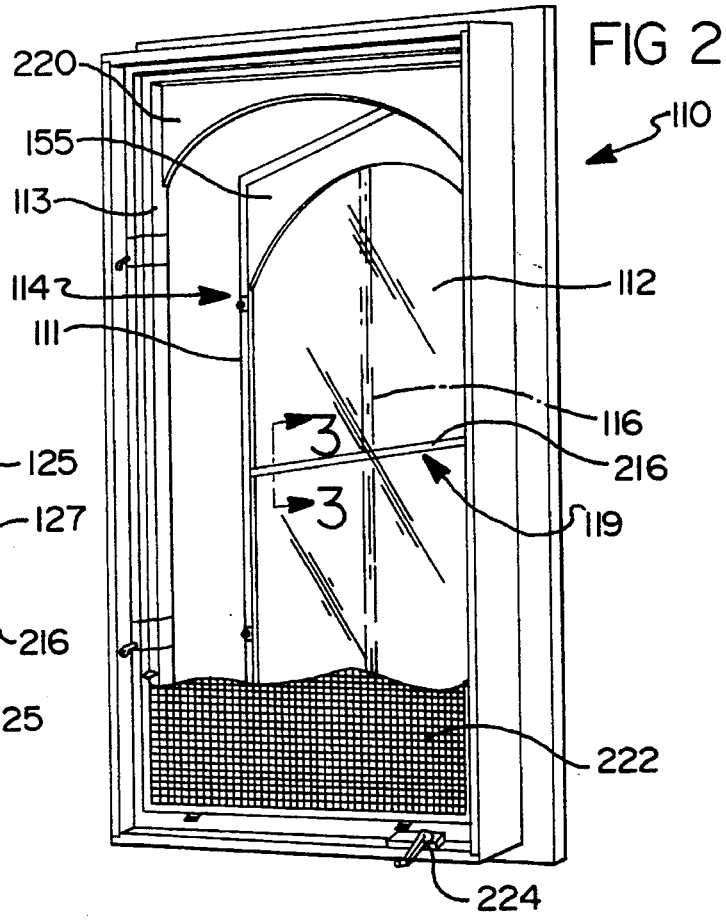
FIG. 2 is an enlarged, interior perspective view of one window assembly of the present invention shown in FIG. 1.

Referring now to FIG. 2, a rear perspective view of the window assembly 110 is shown to demonstrate additional structural details according to a preferred embodiment of the present invention.

The window assembly 110 of FIG. 2 comprises a sash 114 in a window frame 113. A spacer bar 115 (FIG. 7) separates the panes and is sealed at the periphery of the panes to the sash frame members 111 to form a sealed chamber therebetween. A vertical internal muntin bar 116 is disposed between the pair of panes 112 to simulate a divided lite window. Checkrail assembly 119 is located at the center of the pair of sash to simulate a double-hung window style. Interior glass plant-on 216 is aligned with exterior plant-on 118 (FIG. 4) in the checkrail assembly 119. An interior frame plant-on 220 conforms with but is layered above the interior, glass plant-on 155 to interiorly simulate an arched upper edge of the pair of panes 112. In a stationary sash casement windows, the screen would not be used and would not therefore obscure the architecture style applied. The overlayed plant-on may be secured and positioned in the same manner as described in greater detail for the exterior plant-ons in FIG. 6.

A valuable advantage of the present invention is shown in FIG. 2 where the screen 222 is installed on the interior portion of the frame 113 of the window assembly 110. Accordingly, the exterior plant-ons 120 and 153 (FIG. 1) are fully exposed. Finally, a well known standard casement window hardware assembly such as a Truth mechanism, with a crank mechanism 224 for pivotally opening and closing a casement window about a vertical axis, is shown in the lower right corner of the window assembly. The crank assembly hardware includes the hinge hardware on the top and bottom of the sash frame 111, where it presses against the frame 113, in a well-known manner pivotally securing it to the frame 113 for movement between a closed position shown in FIG. 1 and the open position shown in FIG. 2.

Figure 3:
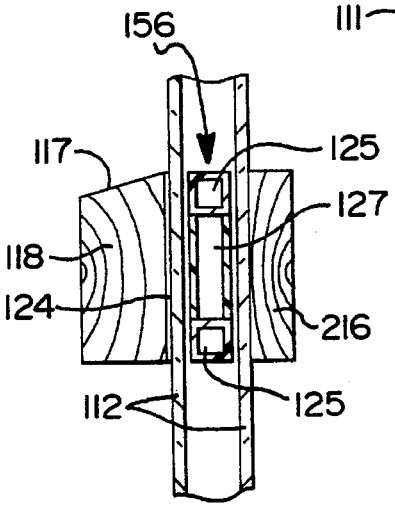
FIG. 3 is an enlarged cross-section of a checkrail assembly employed in the assembly of FIG. 2.

FIG. 3 shows an enlarged cross-section of checkrail assembly 119. Exterior plant-on 118 is shown attached to the exterior surface of the pair of panes 112 using double-sided tape 124. Interior plant-on 216 is shown here, but described more completely in reference to FIG. 5. An interior muntin bar assembly 159 is aligned between interior plant-on 216 and exterior plant-on 118 and formed by parallel tubes 125 spaced apart by a vertical tube 127. As shown in FIG. 3, the muntin bar assembly 156 is preferably spaced from the panes 112 but aligned with tops and bottoms of the check rail plant-ons 118 and 216.

Figure 4:
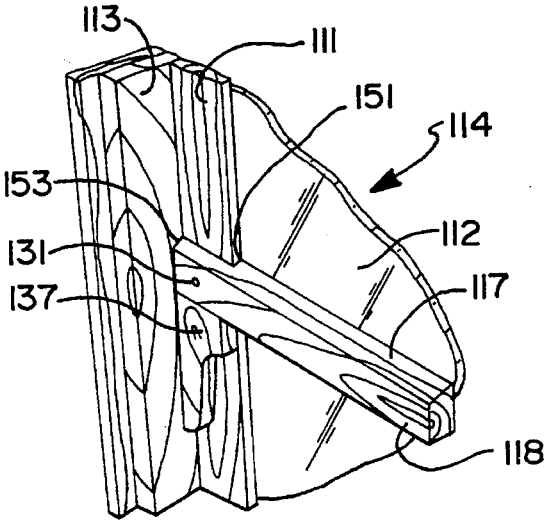
FIG. 4 is an enlarged exterior perspective view of a checkrail assembly employed in the assembly of FIG. 2.

As best shown in FIG. 4, exterior glass plant-on 118 is attached to the sash frame member 111, for example by a removable fastener 131, for each of reglazing. The top surface 117 of checkrail 118 is tapered downwardly away from the glass as shown in FIG. 3 to appear wider than its actual width and to provide positive water run-off. A finished edge such as at 151 or at 153, or both, provide an alignment means for positioning the matching length dimension of the rail 118 adjacent the corresponding width dimension of sash 114. Alternatively, the surfaces 151 and 153 could be cut within a particular tolerance while the fastener 131 serves as an alignment means. Likewise, the finished surfaces of step 137 may form alignment means for matching the stop the width of rail 118 or the transverse width of sash frame 111.

Figure 5:
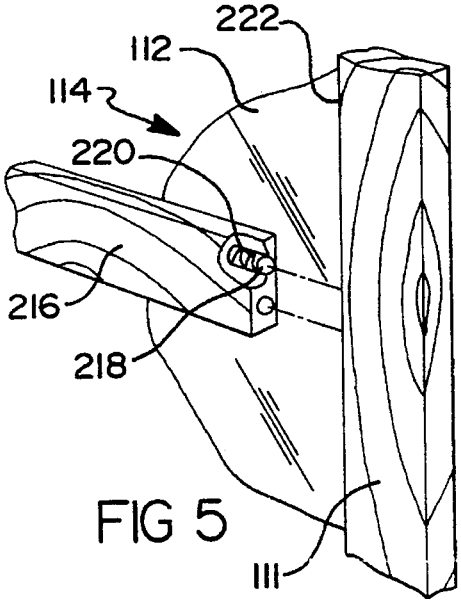
FIG. 5 is an enlarged interior perspective view of the checkrail assembly employed in the window assembly in FIG. 2.

FIG. 5 shows an attachment means for interior plant-on 216 although a double-stick tape such as Arlon foam tape would also be acceptable. However, for ease of removal, the checkrail plant-on 216 includes resilient plastic members 218 having a ball-shaped head, and pressed into a recess 219. The head is resiliently urged into a vertically elongated groove in the side 222 of sash frame 111.

Figure 6:
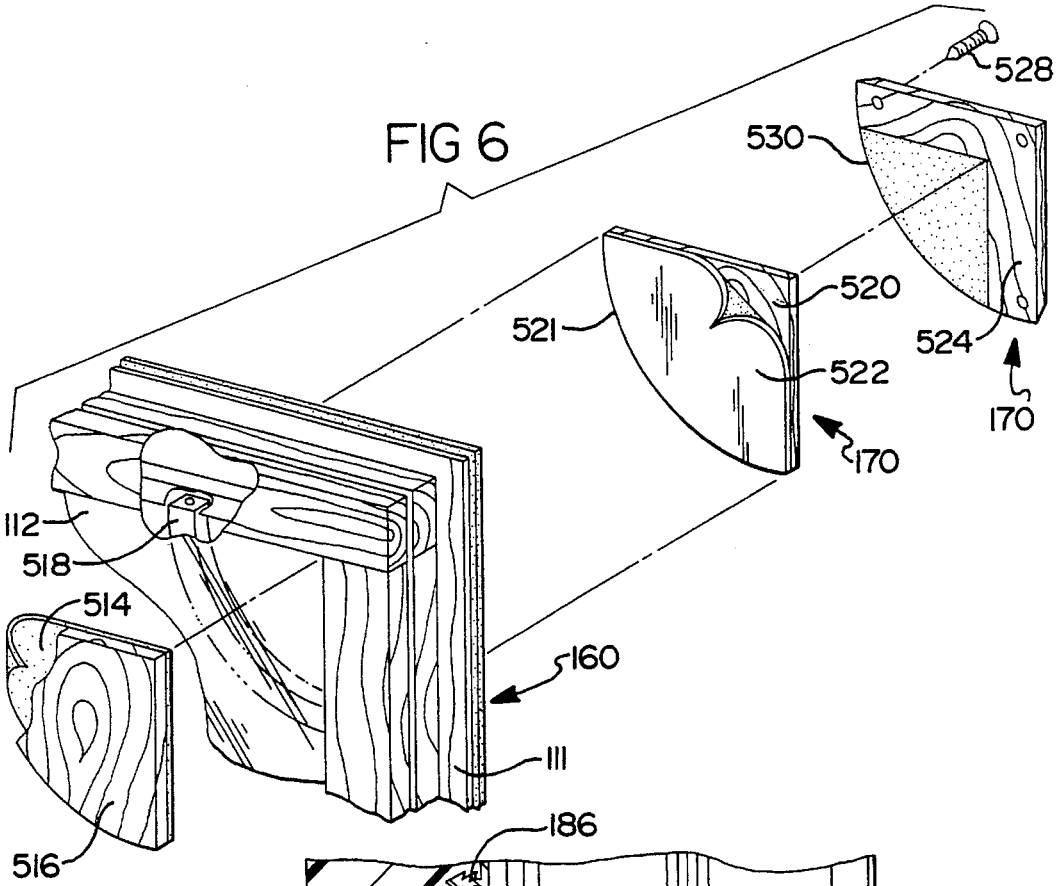
FIG. 6 is an enlarged, exploded perspective view of a plant-on assembly according to the present invention.

FIG. 6 shows an enlarged portion of window assembly 160 including sash plant-on 170. Exterior glass plant-on 170 includes an inner member shown with single-sided adhesive tape 522 having its non-stick surface adjacent the pane 112 and other side adhered to the member 520. Exterior glass plant-on 170 also includes exterior member 524 with adhesive portion 526 for attachment to glass plant-on 520. In addition, exterior sash plant-on member 524 has a portion overlapping sash frame member 111 which allows it to be attached directly to the exterior of sash frame member 111, such as, for example, by removable screw fastener 528. Internal muntin bar 518, between the pairs of panes 112, conforms with the curvature and alignment of the curved edge of interior plant-on 516 and plant-on member 520. The muntin bar is secured to the spacer in a conventional manner, such as a tongue in slot connection. In addition, the curved edge 530 of exterior sash plant-on member 524 is spaced or recessed from edge 521 of plant-on member 520, as shown at 520 and 524 in FIG. 7, to provide an additional depth or shadowing effect. Interior glass plant-on 516 is mounted by double-sided adhesive tape 514 to the interior surface of interior pane 112.

Figure 7:
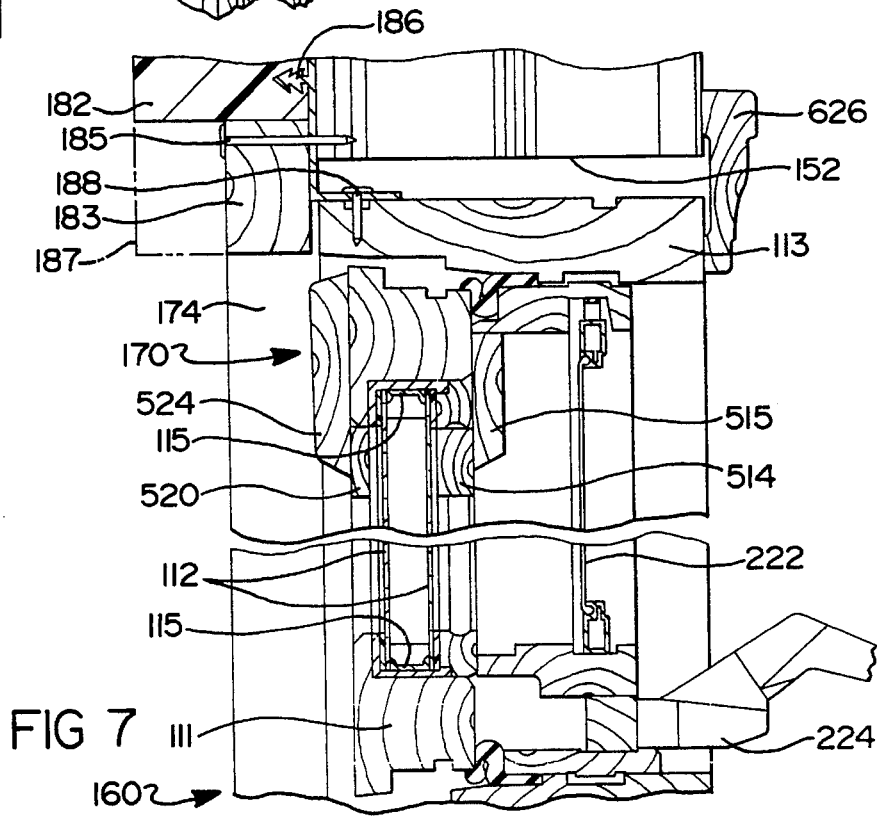
FIG. 7 is a fragmentary sectional view of a window assembly shown in FIG. 1 and showing typical details of a preferred embodiment constructed in accordance with the present invention.

FIG. 7 is a fragmentary sectional view of window assembly 160, but typical of preferred constructions according to the present invention. FIG. 7 shows sash frame member 111 holding a pair of panes 112. Exterior plant-on 170, comprising members 524 and 520, is attached to the exterior surface of the sash frame member 111 as previously discussed. Interior glass plant-on 514 is attached to the interior surface of the interior pane 112. Interior frame plant-on 515 is attached to the interior trim of the interior frame.

Column 174 is shown attached to the wall adjacent to frame 113. Crosshead 182 is shown attached to the wall using fastener 186 above brick molding 183. Fastener 186 is attached to the wall by nail 185 and to frame 113 by nail 188. Nail 185 also attaches brick molding 183 to the wall.

Fastener 186 allows alternative embodiments to be implemented which eliminate the need for brick molding 183. This alternative embodiment permits more efficient installation of window assembly 160 by replacing crosshead 182 with extended crosshead 187.

Interior molding 626 is shown attached to the wall by conventional window trim methods around the window assembly 160 of the present invention. Screen 222 is installed on the interior side of the window assembly 160, and crank mechanism 224 is provided for opening and closing the window.

Figure 8:
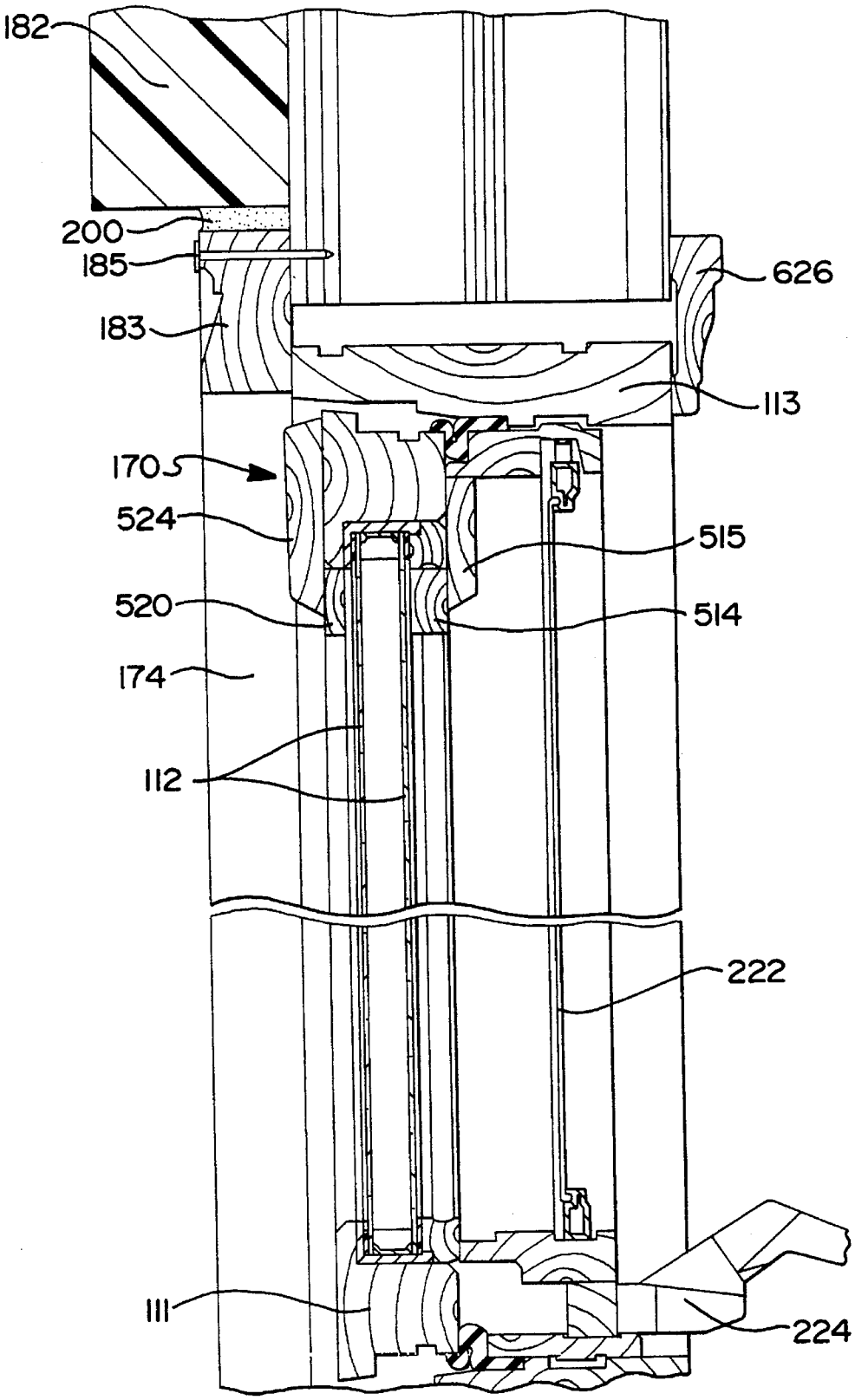
FIG. 8 is a fragmentary sectional view of a window assembly shown in FIG. 1 and showing typical details of a preferred embodiment constructed in accordance with the present invention and FIGS. 9–11 are front elevation views of window assemblies constructed according to the present invention.

FIG. 8 is a fragmentary sectional view of window assembly 160 demonstrating a third, traditional, embodiment involving crosshead 182. In this embodiment, crosshead 182 is attached to the wall above brick molding 183. An inner space between the brick molding and the exterior plant-on 182 is shown filled with a caulking 200 to finish the appearance.

Figure 11:
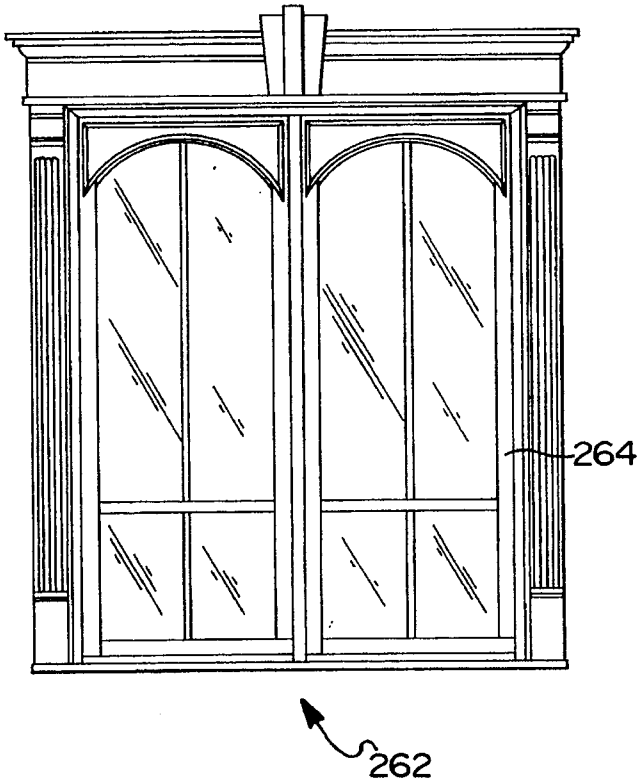
Figure 10:
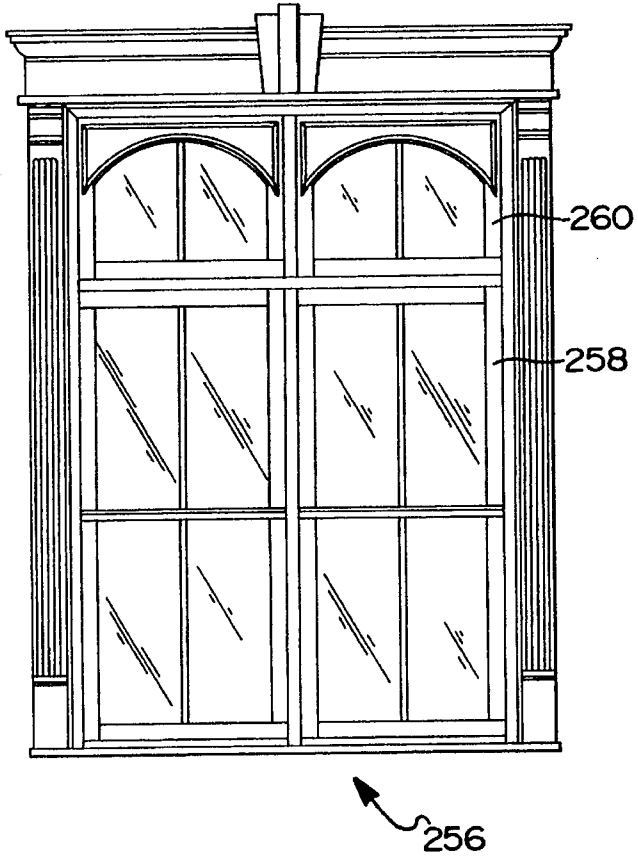
Figure 9:
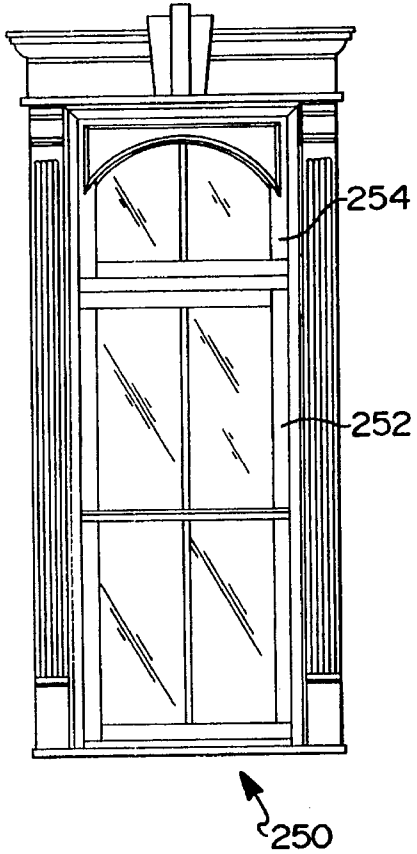

FIG. 9–11 illustrate three window assemblies which are exemplary of the window assemblies of the present invention. Although the preferred embodiment of the present invention is described herein in connection with insulated windows having one sash, the present invention can include insulated windows having more than one sash aligned in a single plane.

The first window assembly 250 of FIG. 9 is a mulled casement window assembly having two sashes. The lower sash 252 is attached to the window frame using a standard casement window assembly. The upper sash 254 is commonly referred to as an upper mullion. The upper mullion 254 is fixably mounted in the window frame and incorporates plant-ons of the present invention.

The second window assembly 256 of FIG. 10 is a mulled casement window assembly having four sashes. The lower sashes 254 are attached to the window frame using standard casement window assemblies. The upper sashes 258 are upper mullions fixably mounted in the window frame and incorporate plant-ons of the present invention.

The third window assembly 262 of FIG. 11 is a casement window assembly having two sashes 264. Using the previously described plant-ons of the present invention, window assembly 262 simulates a window assembly having lower mullions.

Having thus described the present invention, many modifications will become apparent to those of ordinary skill in the art to which it pertains without departing from the scope and spirit of the present invention as defined in the appended claims.

What is claimed is:

1. A window for simulating at least one of a plurality of architectures comprising:

one sash having a sash frame supporting an interior glazing and an exterior glazing in sealing engagement with a spacer frame defining an insulating chamber between the interior and exterior glazings;

a window frame dimensioned to receive said sash in a single plane position within said window frame;

a casement window assembly for attaching the sash to the window framed the casement window assembly for moving the sash with respect to the window frame between an open position and a closed position;

at least one plant-on adjacent to one of said sash and said window frame, said plant-on having a matching dimension corresponding to a contiguous dimension of the one of said sash and said window frame; wherein a first of said at least one plant-on comprises a check rail member to simulate a double-hung window construction; and alignment indicia positioning said matching dimension of said plant-on adjacent to said contiguous dimension of the one of said at least one sash and said window frame.

2. The apparatus of claim 1 wherein the plant-on is a factory plant-on.

3. The apparatus of claim 2 wherein said factory plant-on includes removable retainer for the plant-on.

4. The apparatus of claim 3 wherein said factory plant-on is secured to said sash.

5. The apparatus of claim 3 wherein said factory plant-on is secured to at least one glazing.

6. The apparatus of claim 3 wherein the plant-on is a contoured sash member positioned to overlay one of the exterior glazing and the interior glazing.

7. The apparatus of claim 6 wherein the contoured sash member is positioned in alignment with similarly contoured member positioned between the interior glazing and the exterior glazing.

8. The apparatus of claim 1 wherein the checkrail member has a tapered surface.

9. The apparatus of claim 1 wherein the plant-on is a field plant-on.

10. The apparatus of claim 9 wherein the width of the field plant-on corresponds to the width of the window frame for attachment thereto.

11. The apparatus of claim 9 wherein the height of the field plant-on corresponds to the height of the window frame for attachment thereto.

12. The invention as defined in claim 1 wherein said check rail comprises a bar plant-on visually dividing said sash.

13. The invention as defined by claim 1 wherein said check rail comprises an exterior rail plant-on and an interior rail plant-on.

14. The invention as defined by claim 1 further comprising a screen mounted on an interior portion of said frame.

15. A window for simulating at least one of a plurality of architectures comprising:

a sash having a sash frame supporting an interior glazing and an exterior glazing in sealing engagement with a spacer frame defining an insulating chamber between said interior and exterior glazings;

a window frame dimensioned to receive said sash in a single plane position within said window frame;

a casement window assembly for attaching said at least one sash to said window frame, said casement window assembly for moving said sash with respect to said window frame between an open position and a closed position;

at least one plant-on adjacent to said sash and said frame, said plant-on having a matching dimension corresponding to a contiguous dimension of the one of said sash and said window frame; wherein a first of said at least one plant-on comprises a check rail member to simulate a double-hung window construction; and alignment indicia positioning said matching dimension of said plant-on adjacent to said contiguous dimension of the one of said sash and said frame.

16. The invention as defined by claim 15 further comprising a screen mounted on an interior portion of said frame.

17. A window for simulating a double-hung window comprising:

one sash having a sash frame supporting an interior glazing and an exterior glazing in sealing engagement with a spacer frame defining an insulating chamber between the interior and exterior glazings;

a window frame dimensioned to receive said sash in a single plane position within said window frame;

a casement window assembly for attaching the sash to the window frame, the casement window assembly for moving the sash with respect to the window frame between an open position and a closed position; and a check rail assembly to simulate a double-hung window construction positioned adjacent to said sash for simulating a double-hung window comprising:

at least one plant-on adjacent to one of said sash and said window frame, said plant -on having a matching dimension corresponding to a contiguous dimension of the one of said sash and said window frame; and alignment indicia positioning said matching dimension of said plant-on adjacent to said corresponding contiguous dimension of the one of said sash and said window frame.

18. The apparatus of claim 17 wherein said checkrail assembly includes a plant-on mounted exteriorly adjacent to the exterior glazing for visually defining an upper glazing portion and a lower glazing portion.

19. The apparatus of claim 17 wherein said checkrail assembly includes a plant-on mounted interiorly adjacent to the interior glazing for visually defining an upper glazing portion and a lower glazing portion.

20. The apparatus of claim 17 wherein said checkrail assembly includes a muntin bar positioned between said interior and exterior glazings for visually defining an upper glazing portion and a lower glazing portion.

21. The invention as defined claim 17 wherein said check rail plant-on includes an upper surface tapering downwardly from an adjacent glazing.

22. The invention as defined in claim 17 wherein said check rail assembly comprises an elongated bar plant-on visually dividing said sash, and further comprising a sash stop under each longitudinal end of said bar.

* * * * *